US006565171B2

(12) United States Patent
Miquel et al.

(10) Patent No.: US 6,565,171 B2
(45) Date of Patent: May 20, 2003

(54) METHOD FOR REDUCING VERTICAL BANDING

(75) Inventors: Antoni Gil Miquel, Barcelona (ES); Jesus Soto, Barcelona (ES); Fabien Chanussot, Le Creusot (FR)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/904,606

(22) Filed: Jul. 16, 2001

(65) Prior Publication Data

US 2003/0016255 A1 Jan. 23, 2003

(51) Int. Cl.[7] ..... B41J 23/00
(52) U.S. Cl. ..... 347/5; 347/37; 400/627
(58) Field of Search ..... 347/5, 16, 37, 347/38, 39, 41, 104; 400/279, 283, 627; 271/276

(56) References Cited

U.S. PATENT DOCUMENTS 5,397,192 A * 3/1995 Khormaee ..... 400/708
5,992,968 A * 11/1999 Uetsuki et al. ..... 347/37
6,203,139 B1 * 3/2001 Beauchamp ..... 347/37
6,206,591 B1 * 3/2001 Kato ..... 400/627
6,354,216 B1 * 3/2002 Yoshida ..... 101/492

FOREIGN PATENT DOCUMENTS

EP 555 983 A1 * 8/1993 ..... F04D/29/66
EP 1 057 647 A2 * 6/2000 ..... B41J/2/21

OTHER PUBLICATIONS

Dorf, The Electrical Engineering Handbook, 1997, CRC Press, 2nd edition, pp. 1457–1459.*

* cited by examiner

*Primary Examiner*—Lamson Nguyen
*Assistant Examiner*—Blaise Mouttet

(57) ABSTRACT

Variances are introduced into at least one component of a large format inkjet printer to substantially reduce the formation of vertical bands during a printing process. In one respect, the relationship between the carriage speed and the vibrations caused by operation of the voltage receiving component is utilized in the implementation of the variances. That is, operation of the voltage receiving component creates a temporal frequency caused by its vibration which leads the carriage to vibrate at a certain rate of time (temporal frequency) as it travels across the printing pass. At least by virtue of the travel across the printing pass, the carriage converts the temporal frequency caused by the vibrations of the carriage and the voltage receiving component into a spatial frequency. The temporal frequency generally translates into a delay or an event that occurs at certain moments in time which may cause drops of ink that are fired to be misplaced on the medium. By altering the temporal frequency of the voltage receiving component and/or the carriage speed at certain times during the printing operation, the spatial frequencies at which the delays or events occur may be spread out to prevent them from accumulating and resulting in vertical banding.

29 Claims, 5 Drawing Sheets

METHOD FOR REDUCING VERTICAL BANDING

FIELD OF THE INVENTION

This invention relates generally to inkjet printers. More specifically, the invention relates to a technique for substantially reducing vertical banding from printing operations performed by inkjet printers that utilize vacuum fans.

BACKGROUND OF THE INVENTION

FIG. 1 illustrates a conventional large format inkjet printer 110 having a pair of legs 114, left and right sides 116, 118, and a cover 122. This example will be used to illustrate some of the problems associated with known large format inkjet printers. As illustrated in FIG. 1, the printer 110 includes a carriage 100 supporting a plurality of printheads 102–108. The carriage 100 is coupled to a slide rod 124 with a coupling 125. As is generally known to those of ordinary skill in the art, during a printing operation, the carriage 100 travels along the slide rod 124 generally in a Y-axis direction 103 to make a printing pass. In addition, as the carriage 100 travels along the Y-axis 103, certain of the printheads 102–108 drop ink onto a medium 130, e.g., paper, through a plurality of nozzles (not shown). At certain times during the printing operation, the medium 130 typically travels generally in a X-axis direction 101. By virtue of performing a plurality of printing passes over the medium 130 by the carriage 100 in the above-described manner, an image, e.g, plot, text, and the like, may be printed onto the medium.

Also illustrated in FIG. 1 is a printer control panel 120 located on a right side 118 of the large format inkjet printer 110. The printer control panel 120 typically functions as an interface between a user and the printer 110 to enable certain printer operations to be set (e.g., medium advance, printmode, etc.). In addition to housing the printer control panel 120, the right side 118 of the printer 110 typically also houses printer components for performing printing operations (e.g., printer electronics, a service station for servicing operations on the printheads 102–108, etc.).

During a printing operation, the accuracy of ink drop placement onto the medium 130 may be relatively compromised by virtue of a plurality of factors. For example, small inaccuracies due to uncontrolled movements, oscillations, etc., may cause faults in the printing output to become visible. In this respect, the printing quality may be adversely affected by operation of electromechanical components, e.g., vacuum fans, coupled to the printers. For example, operation of these types of electromechanical components may cause the printers to suffer from some of the above-stated inaccuracies. That is, during the operation of these types of electromechanical components, the electronic components may have a tendency to vibrate at certain frequencies, thus causing other components, e.g., printheads 102–108, of the printers to undergo uncontrolled movements at a periodic rate. One result of the uncontrolled movements at a periodic rate is that vertical bands may be created in the printed image, e.g., plot, text, and the like.

In order to overcome some of the problems associated with misalignment of fired ink drops during printing operations, many inkjet printers have employed what is known as a multi-pass print mode. In a multi-pass print mode, instead of performing a single pass over a print swath, two or more passes are made with different nozzles to fire ink drops during each pass. In this respect, in a four pass print mode, for example, only one of four ink droplets may be missing or misdirected resulting in a much less catastrophic result. While the multi-pass printing technique has improved image quality for those situations in which failed nozzles are present, this technique has been relatively unsuccessful in removing vertical bands resulting from vibrations caused by operation of the above-described electromechanical components. In one respect, the source of vertical banding may not be successfully randomized with the increased number of passes. That is, the vibrations that are coupled to the carriage 100 may typically result in dot placement errors (DPE) of the same spatial frequency. Thus, the DPE have a tendency to accumulate when a multi-pass print mode is utilized, resulting in the formation of vertical bands.

Referring now to FIG. 2, which is an enlarged sectional view of the printer 110 illustrated in FIG. 1, with the cover 122 removed, an example of an electromechanical component that may cause vertical banding is shown. As shown in FIG. 2, a space is formed between the left and right sides 116, 118 of the printer 110 defining an area in which the medium (not shown) may be printed upon. Generally extending along the print area is a serpentine-shaped opening 126 for applying vacuum pressure on a lower surface of the medium (not shown). In this respect, air is drawn in through the serpentine opening 126 to generally maintain the position of the medium in the print area.

Referring now to FIG. 3, which is a sectional view of the printer 110 generally below the print area, a vacuum fan 140 is illustrated. As stated hereinabove, the vacuum fan 140 is an example of an electromechanical component whose operation may cause the print quality to be adversely affected by its operation. As illustrated in FIG. 3, the vacuum fan 140 typically operates to draw air from the serpentine-shaped opening 126 and through an underside of the printer 110. When the vacuum fan 140 is activated and is in operation, the vacuum fan typically rotates at a certain frequency, depending upon the amount of voltage supplied to the vacuum fan.

At least by virtue of the direct coupling between the vacuum fan 140 and the printer 110, the rotation of the vacuum fan causes the printer to vibrate at a certain degree corresponding to the frequency of rotation of the vacuum fan. One result of the vibration is that the printheads 102–108 may undergo uncontrolled movements at certain times during a printing operation. Typically, the uncontrolled movements occur at a periodic rate, often due to the periodic nature of the vibrations, oftentimes resulting in the uncontrolled movements occurring at the same or substantially similar locations along each printing pass, thus resulting in the formation of vertical bands.

One solution to the above-stated problem of vertical band formation has been to attempt to substantially mechanically isolate the vacuum fan 140 from the printer 110 and thus attempt to prevent the vibrations caused in the operation of the vacuum fan from affecting the other components of the printer, namely the operation of the printheads 102–108. However, even relatively substantial mechanical isolation of the vacuum fan 140 from the printer 110 has been found to be relatively insufficient in preventing the translation of the vibrations to other printer components. In addition, it has been found that the attempt to substantially mechanically isolate the vacuum fan 140 from the printer 110 typically increases the costs in fabricating the printer by relatively large amounts. Thus, even substantial mechanical isolation of the vacuum fan 140 from the printer 110 has not proven to be a substantially viable solution to some of the vertical band formation problems that may occur during printing operations.

SUMMARY OF THE INVENTION

According to one aspect, the present invention pertains to a method for reducing vertical banding in a printing device having a printhead for printing onto a medium and a voltage receiving component coupled to the printing device, in which, operation of the voltage receiving component may cause the voltage receiving component to vibrate at a frequency of oscillation that is configured to vary according to the degree of voltage supplied to the voltage receiving component. In the method, a first voltage is supplied to the voltage receiving component and a printing pass is performed over the medium. In addition, the first voltage supplied to the voltage receiving component is varied to a second voltage in order to vary the frequency of oscillation of the voltage receiving component. Moreover, the second voltage is supplied to the voltage receiving component, and another printing pass is performed over the medium.

According to another aspect, the present invention pertains to a method for reducing vertical banding in a printing device having a printhead for printing onto a medium and a voltage receiving component coupled to the printing device, in which operation of the voltage receiving component may cause the voltage receiving component to vibrate at a frequency of oscillation that is configured to vary according to the degree of voltage supplied to the voltage receiving component. In the method, a printing pass is performed over the medium at a first speed. In addition, the first speed is varied to a second speed, such that the second speed is not equal to the first speed. Moreover, another printing pass is performed over the medium at the second speed.

According to yet another aspect, the present invention relates to a computer readable storage medium on which is embedded one or more computer program(s), the one or more computer program(s) implementing a method for reducing vertical banding during a printing operation of a printer. The one or more computer program(s) include a set of instructions for supplying a first voltage to a voltage receiving component, performing a first printing pass over a medium, and varying the first voltage supplied to the voltage receiving component to a second voltage to thereby vary a frequency of oscillation of the voltage receiving component. The one or more computer program(s) also include a set of instructions for supplying the second voltage to the voltage receiving component and performing another printing pass over the medium.

Certain embodiments of the present invention are capable of achieving certain advantages, including, the relative reduction in the formation of vertical bands during a printing process.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

Figure 1:
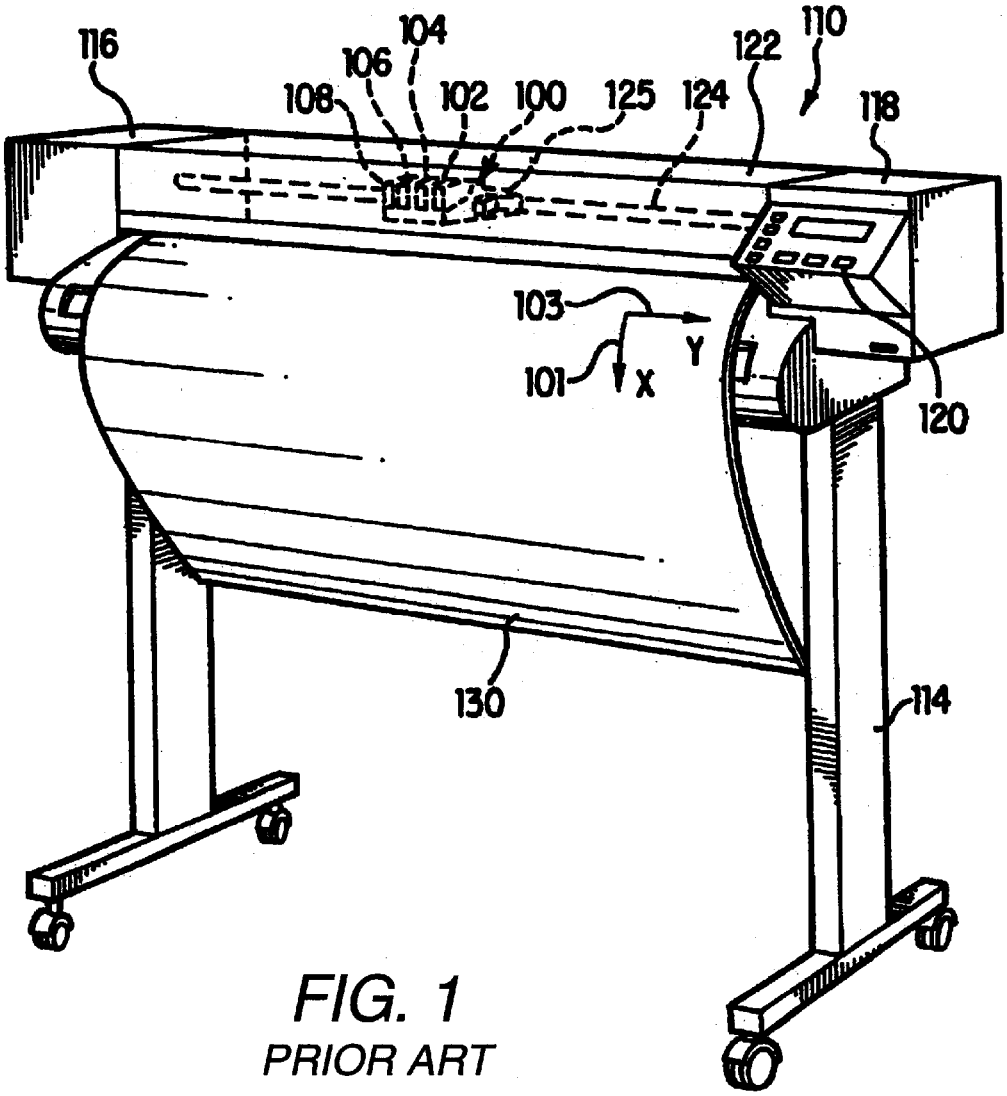
FIG. 1 PRIOR ART
FIG. 1 is a perspective view of a conventional large format inkjet printer.
Figure 2:
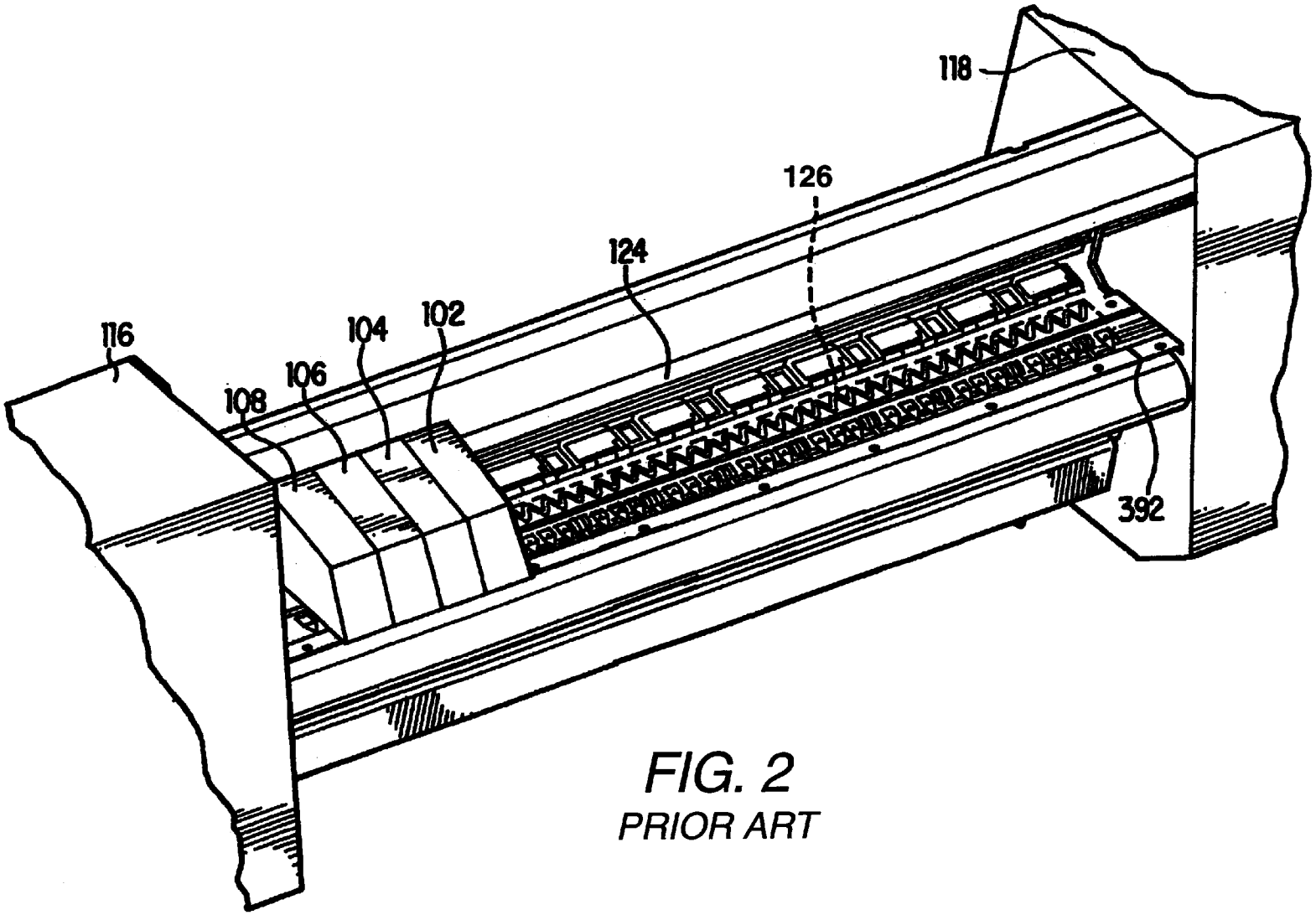
FIG. 2 PRIOR ART
FIG. 2 is a sectional perspective view of the large format inkjet printer illustrated in FIG. 1 showing a serpentine opening for drawing air into a body of the printer to thus substantially maintain a position of a medium located over the serpentine opening.
Figure 3:
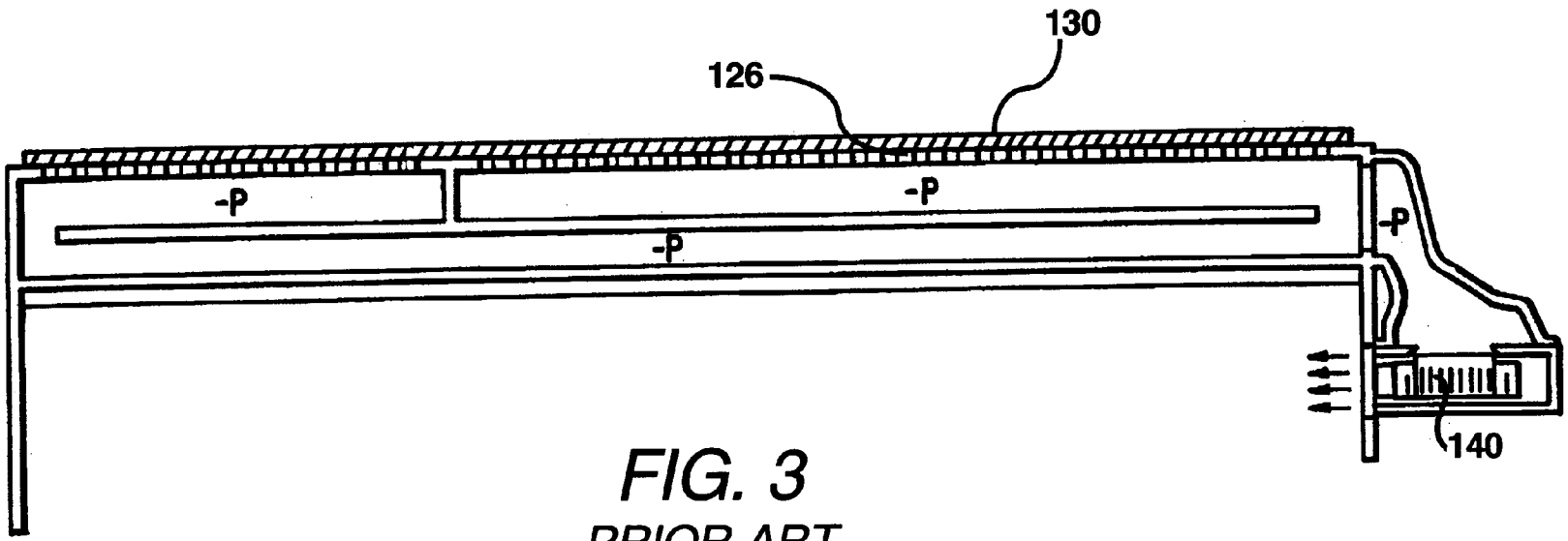
FIG. 3 PRIOR ART
FIG. 3 is a cross-sectional elevational front view of the large format inkjet printer illustrated in FIG. 1, illustrating the position and operation of a vacuum fan.

For simplicity and illustrative purposes, the principles of the present invention are described by referring mainly to an exemplary embodiment thereof, particularly with references to an example of a large format inkjet printer having a vacuum holder whose operation may cause vertical bands to be formed during a printing operation of the large format inkjet printer. However, one of ordinary skill in the art would readily recognize that the same principles are equally applicable to, and can be implemented in, any printer that utilizes any electromechanical component whose operation may cause the printer to vibrate and thus cause vertical bands to be formed during a printing operation of the printer, and that any such variation would be within such modifications that do not depart from the true spirit and scope of the present invention.

In accordance with the principles of the present invention, a technique for reducing the formation of a vertical bands during a printing operation of a large format inkjet printer possessing an electromechanical component is disclosed. In this respect, as described in further detail hereinbelow, certain variances are introduced into at least one component of the large format inkjet printer to substantially prevent the formation of vertical bands during a printing process. Throughout the present disclosure, it is to be understood that "voltage receiving component" may comprise any electromechanical component whose operation may cause the printer to vibrate.

According to one aspect, the present invention utilizes the relationship between carriage speed, which is the speed at which the carriage (and thus the printheads) of the printer travels during a printing pass, e.g., printing a swath, over the medium, and the vibrations caused by operation of the voltage receiving component. That is, operation of the voltage receiving component creates a temporal frequency caused by its vibration. Additionally, the carriage oscillates at a certain rate of time (temporal frequency) as it performs a printing pass. At least by virtue of the travel across the printing pass, the carriage converts the temporal frequency caused by the carriage and the voltage receiving component into a spatial frequency.

The temporal frequency generally translates into a delay or an event that occurs at certain moments in time. Thus, the travel of the carriage converts these delays or events into a spatial frequency, resulting in drops of ink fired from the nozzles of the printheads being misplaced on the medium, at certain moments in time. The temporal frequency typically tends to occur at the same or similar times during the printing operation, thus, the positions at which the drops of ink are misfired typically tend to occur at substantially the same position along the printing pass, oftentimes resulting in the formation of vertical bands in the printed image. According to the present invention, by altering the temporal frequency of the voltage receiving component and/or the carriage speed at certain times during the printing operation, the spatial frequencies at which the delays or events occur may be spread out to substantially prevent the spatial frequencies from accumulating and resulting in vertical banding.

Figure 4:
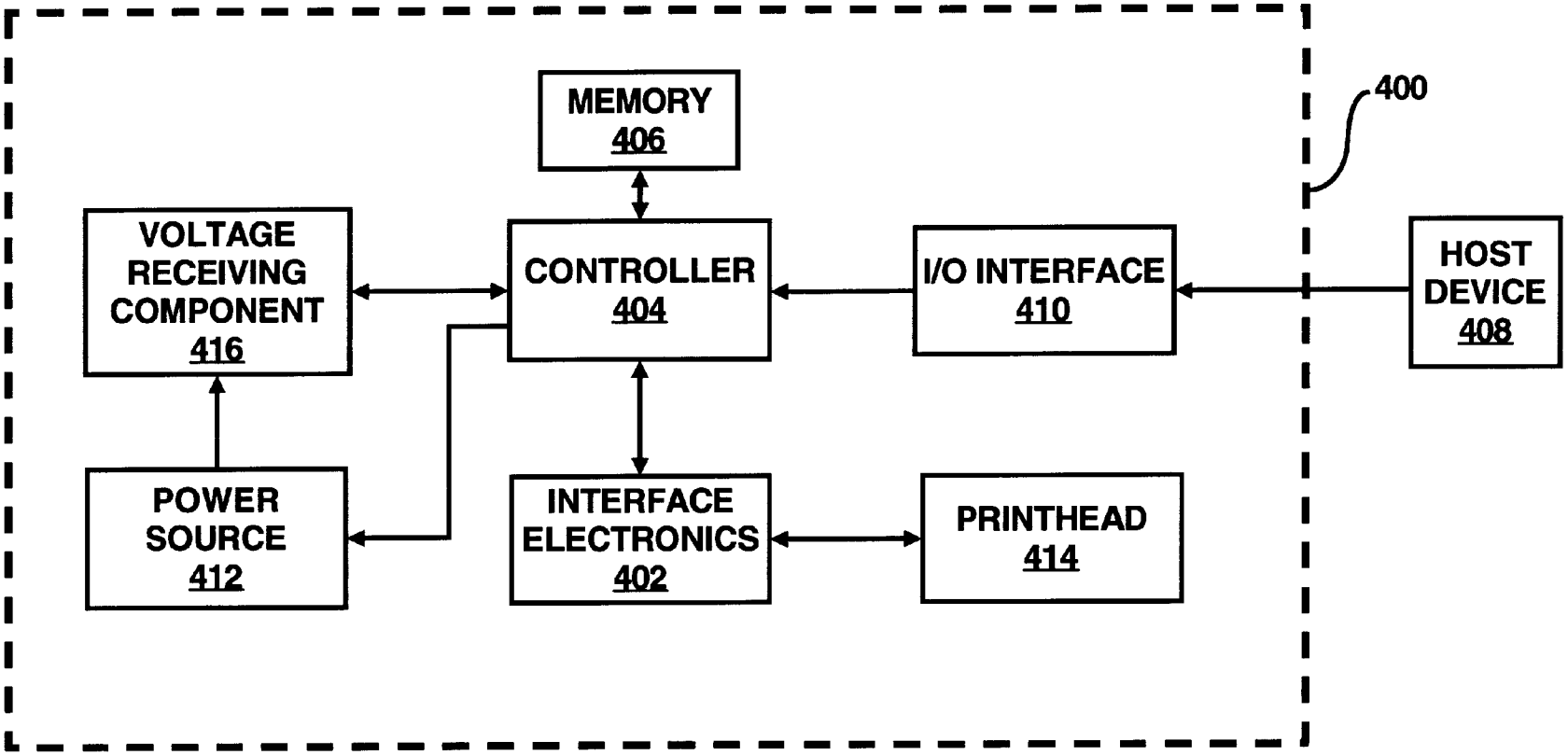
FIG. 4 illustrates an exemplary block diagram of a printer in accordance with the principles of the present invention.

Referring to FIG. 4, an exemplary block diagram of a printer 400 in accordance with the principles of the present invention is illustrated. As will become better understood from a reading of the present disclosure, the following description of the block diagram of FIG. 4 illustrates one manner in which a large format inkjet printer 400 having a voltage receiving component 416 may be operated. In this respect, it is to be understood that the following description is but one manner of a variety of different manners in which such a large format inkjet printer may be operated.

The printer 400 includes a plurality of elements, including a printhead 414. Although, for illustrative purposes, the printer 400 is described as a large format inkjet printer, it should be understood and readily apparent to those skilled in the art that the vertical band formation reduction technique disclosed herein may be implemented in any reasonably suitable type of printer without departing from the scope or spirit of the present invention. Additionally, although reference is made to a single printhead 414, it is to be understood that the printer 400 may include any reasonably suitable number of printheads.

The printhead 414 is configured to repeatedly pass across a medium in individual, horizontal swaths or passes during a printing operation to print a selected image (e.g., picture, text, diagrams, etc.) onto the medium. The printhead 414 may be configured to contain a plurality of nozzles (not shown), which are operable to be implemented during each pass to apply an ink pattern onto the medium and thus print the selected image.

As also illustrated in FIG. 4, the printer 400 also includes interface electronics 402. The interface electronics 402 may be configured to provide an interface between a controller 404 of the printer 400 and the components for moving the printhead 414, e.g., a carriage, belt and pulley system (not shown), etc. The interface electronics 402 may include, for example, circuits for moving the printhead 414, the medium, firing individual nozzles of the printhead, and the like.

The controller 404 may be configured to provide control logic for the printer 400, which provides the functionality for the printer. In this respect, the controller 404 may possess a microprocessor, a micro-controller, an application specific integrated circuit, and the like. The controller 404 may be interfaced with a memory 406 configured to provide storage of a computer software that provides the functionality of the printer 400 and may be executed by the controller 404. The memory 406 may also be configured to provide a temporary storage area for data/file received by the printer 400 from a host device 408, such as a computer, server, workstation, and the like. The memory 406 may be implemented as a combination of volatile and non-volatile memory, such as dynamic random access memory ("RAM"), EEPROM, flash memory, and the like. It is also within the purview of the present invention that the memory 406 may be included in the host device 408.

Referring again to FIG. 4, the controller 404 is further interfaced with an I/O interface 410 configured to provide a communication channel between a host device 408 and the printer 400. The I/O interface 410 may conform to protocols such as RS-232, parallel, small computer system interface, universal serial bus, etc. In addition, the controller 404 is interfaced with a voltage receiving component 416, such as a vacuum fan, motors, piezoelectric components, etc., to control its operation. Although not illustrated in FIG. 4, interface electronics may be provided between the controller 404 and the voltage receiving component 416 in a fashion similar to that described hereinabove with respect to the interface electronics 402 provided between the controller and each printhead 414. Moreover, the controller 404 is interfaced with a power source 412 configured to supply voltage to the voltage receiving component 416. In one respect, the controller 404 is operable to control the speed of the voltage receiving component 416, e.g., vacuum fan, by controlling the amount of voltage supplied thereto by the power source 412. The power source 412 may be the power source that supplies power to other components of the printer or it may be a separate power source.

Figure 5:
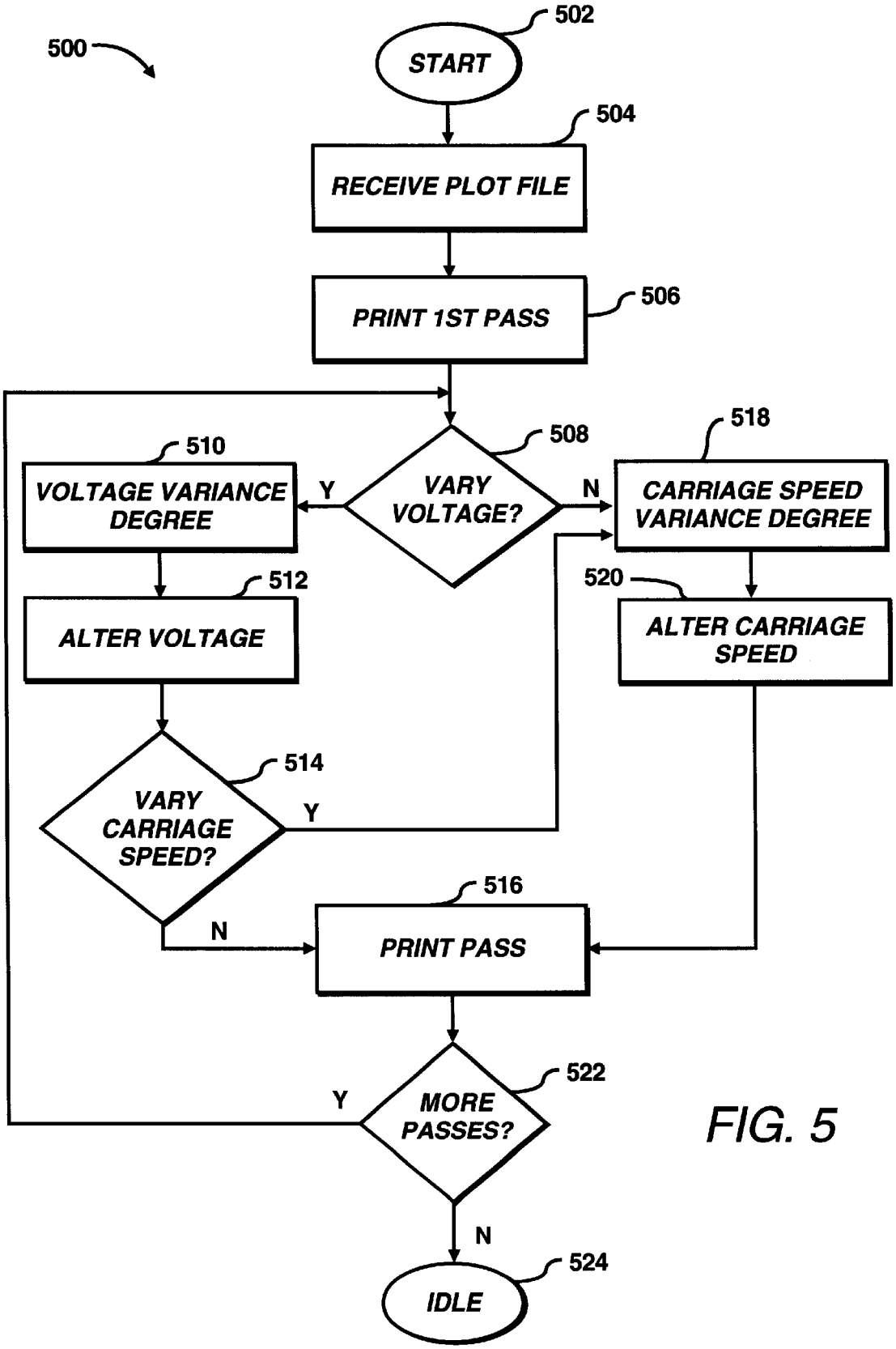
FIG. 5 illustrates an exemplary flow diagram of a manner in which the principles of the present invention may be practiced.

FIG. 5 illustrates an exemplary flow diagram 500 of a manner in which the principles of the present invention may be practiced. The following description of the flow diagram 500 is made with reference to the block diagram illustrated in FIG. 4, and thus makes reference to the elements cited therein. It is to be understood that the steps illustrated in the flow diagram 500 may be contained as a subroutine in any desired computer accessible medium. Such medium including the memory 406, internal and external computer memory units, and other types of computer accessible media, such as a compact disc readable by a storage device. Thus, although particular reference is made in the following description of FIG. 5 to the controller 404 as performing certain printing functions, it is to be understood that those functions may be performed by any desired computer accessible medium.

From the start step 502, the printer 400 receives a plot file from a host device 408 in step 504. The plot file may be stored in the memory 406 in its entirety or the plot file may be stored on a separate computer accessible medium, with certain portions of the plot file being sent to the printer at certain times. The controller 404 is configured to operate the printhead 414 to print the plot file onto a medium, such as the medium 130 illustrated in FIG. 1. In this respect, the controller 404 may be configured to operate the printhead 414, as well as the nozzles (not shown) provided therein in such a manner as to prolong their useful lives. For example, the controller 404 may be configured to operate the printhead 414 in such a manner that individual ones of the nozzles are not fired repeatedly and for a relatively long period of time. Additionally, the controller 404 may be configured to implement a multi-pass printing process by breaking down a typically single pass into a plurality of passes to prevent the printhead 414 from exceeding a predetermined temperature as well as to overcome potential defects which may occur during a printing process as described hereinabove.

In addition, the controller 404 may also be configured to select the amount of voltage supplied to the voltage receiving component 416 by the power source 412. Under normal operating conditions, the controller 404 may be configured to supply the voltage receiving component 416 with a set amount of voltage from the power source 412, in which the amount of voltage may be selected from testing to determine the optimal performance of the voltage receiving component. Thus, for example, when the voltage receiving component 416 comprises a vacuum fan, the amount of voltage and thus the amount of vacuum pressure created by its operation is set such that a medium may be held in the print area with relatively sufficient force, without creating substantially any additional problems.

When the voltage receiving component 416 receives the set amount of voltage, the voltage receiving component may vibrate, and the vibration may be coupled to the other components of the printer 400, at least by virtue of the physical connection between the voltage receiving component 416 and the printer. The coupled vibration may cause dot placement errors (DPE) to occur during the printing operation. At least by virtue of a substantially constant voltage supply to the voltage receiving component 416, the frequency at which the voltage receiving component vibrates is also substantially constant.

In step 506, the controller 404 may operate the printhead 414 to perform a first printing pass over the medium.

In step 508, the controller 404 may determine whether the voltage supplied to the voltage receiving component 416 is set to be varied. In this respect, the determination may be set to occur randomly or a user may set the controller 404 to continuously vary the voltage. If the voltage is to be varied, then step 510 is initiated. In step 510, the controller 404 selects a degree of voltage variance to be supplied to the voltage receiving component 416. The degree of voltage variance may be selected from a range of acceptable voltage variances. According to a preferred embodiment of the present invention, the degree of voltage variance is about a maximum of ±10% of the normal operating voltage. By relatively limiting the degree of voltage variance to about a maximum of ±10% of the normal operating voltage, the operation of the voltage receiving component 416 may not be substantially affected. In addition, the range of acceptable voltage variances may be selected according to a plurality of factors. These factors may include, for example, the effect on the operation of the voltage receiving component, the effect on vertical band formation, and the like. Moreover, the range of acceptable voltage variances may be determined through an optimization process.

The controller 404 may select the degree of voltage variance in a variety of different manners. According to a preferred embodiment of the present invention, the controller 404 may randomly select the degree of voltage variance, while preventing the voltage variances from repeating every four passes (for a multi-pass printing operation containing four passes). Additionally, the controller 404 may select the degree of voltage variance according to a set pattern, such as a mathematical formula, predetermined degrees of variances, and the like.

In step 512, the controller 404 may apply the selected degree of voltage variance by controlling the amount of voltage supplied to the voltage receiving component 416 from the power source 412. As described hereinabove, by altering the degree of voltage supplied to the voltage receiving component 416, the frequency at which the voltage receiving component rotates is relatively different than the frequency of rotation during normal operating conditions. Thus, the frequency at which the vibrations caused by operation of the voltage receiving component 416 may cause other components of the printer 400 to vibrate also relatively differs.

At step 514, the controller may determine whether the carriage speed is set to be varied. In this respect, the determination may be set to occur randomly or a user may set the controller 404 to continuously vary the carriage speed. If the carriage speed is not set to be varied, another printing pass may performed at step 516.

If, in step 508, the voltage is not set to be varied, the controller 404 may select a degree of carriage speed variance as shown at step 518. In addition, if, at step 514, the carriage speed is set to be varied, then the controller 404 also selects a degree of carriage speed variance as shown at step 518. For example, under normal operating conditions (e.g., printing the first pass), the carriage speed may be about 38.33 inches per second (ips), generally depending upon the selected printmode. Additionally, in conventional large format inkjet printers, at least by virtue of the carriage speed in variable speed printmodes typically equaling multiples of about ±8% or 1.66 ips, in accordance with a preferred embodiment of the present invention, the range of acceptable carriage speeds is also maintained at multiples of about ±8%, or 1.66 ips (1Δ), or ±16% or 3.33 ips (2Δ), etc. In this respect, if a ±1Δ printmode is set as the range of acceptable carriage speeds, then, the range of acceptable carriage speeds may include about 40 ips, 38.33 ips, and 36.66 ips. Moreover, if a ±2Δ printmode is set as the range of acceptable carriage speeds, and the original printmode is set at about 36.66 ips, then, the range of acceptable carriage speeds may include about 40 ips, 38.33 ips, 36.66 ips, 35 ips, and 33.33 ips.

As may be seen from the set of acceptable carriage speeds above, in the ±2Δ printmode, the range of acceptable carriage speeds may include those in the ±1Δ printmode. In the ±1Δ printmode, the range of acceptable carriage speeds may include up to three different carriage speeds. Additionally, in the ±2Δ printmode, the range of acceptable carriage speeds may include up to five different carriage speeds. In addition to the above, it should be readily apparent to those having ordinary skill in the art that the range of acceptable carriage speeds may be selected by their effect on a variety of factors to thus optimize the printing process. These factors may include, for example, the effect on throughput, the effect on dot placement accuracy, and the like.

The controller 404 may select the degree of carriage speed variance in a variety of different manners. According to a preferred embodiment of the present invention, the controller 404 may randomly select the degree of carriage speed variance, while preventing the carriage speed variances from repeating every four passes (for a multi-pass printing operation containing four passes). Additionally, the controller 404 may select the degree of carriage speed variance according to a set pattern, such as a mathematical formula, predetermined degrees of variances, and the like.

In step 520, the controller 404 may apply the selected range of carriage speeds by altering the speed of the carriage supporting each printhead 414 during a printing pass. At least by virtue of the various carriage speeds during each printing pass, the positions along the printing pass at which the vibrations caused by the voltage receiving component 416 may affect the operation of each printhead 414 is varied. Thus, the carriage speed is a mechanism through which the temporal vibrations caused by the voltage receiving component 416 may be controlled because the carriage speed is the means through which the temporal vibrations are converted into spatial vibrations.

At step 516, the controller 404 instructs the printhead 414 to perform another printing pass at the altered carriage speed.

The flowchart 500 illustrated in FIG. 5 depicts a preferred embodiment of the present invention. That is, both the voltage supplied to the voltage receiving component 416 and the speed of the carriage maneuvering the printheads 414 are illustrated as being capable of variation. By varying both of these by a relatively small amount, the effectiveness of the voltage receiving component 416 and the throughput are not substantially affected. It is, however, within the purview of the present invention that only one of the supplied voltage and the carriage speed may be varied. In this regard, it may be possible to reduce the level of vertical banding caused by the vibrations of a voltage receiving component 416 by varying only one of the supplied voltage and the carriage speed.

As an example of the principles of the present invention, if the voltage receiving component 416 comprises a vacuum fan that operates at a frequency (f) of 90 Hz, the period (T), equal to 1/f, is equal to 11.1 ms. The wavelength (λ) is equal to the carriage speed (v) times the period (T).

Thus, if the carriage speed (v) is 40 ips, then:

$\lambda=40*11.1\times10^{-3}$ which yields a value of $\lambda=0.44$ inch.

If the carriage speed (v) is 33.33 ips, then:

$\lambda=33.33*11.1\times10^{-3}$ which yields a value of $\lambda=0.37$ inch.

If, for example, the voltage supplied to the vacuum fan may be altered by ±10%, thus, yielding a change in the vibration frequency of about ±10%, then:

$f\in[81,99]$ Hz$\Rightarrow T=1/f\in[10.1,12.3]$ ms

The result of combining these three T values with three of the carriage speeds recited hereinabove are illustrated in the following Table 1.

TABLE 1

| | A | B | C | D |
|---|---|---|---|---|
| I | | 10.1 | 11.1 | 12.3 |
| II | 33.3 | 0.336 | .370 | .410 |
| III | 36.6 | 0.370 | 0.407 | 0.451 |
| IV | 40.0 | 0.404 | 0.444 | 0.492 |

In Table 1, the values recited in column A correspond to three of the carriage speeds in a 2Δ printmode. The values listed in row I correspond to the T values for vacuum fan frequencies of 81 Hz, 90 Hz, and 99 Hz. Additionally, the values listed in columns B–D and rows II–IV correspond to the wavelengths (λ), calculated from the equation s=vT. As may be seen from these values, the combination of varying the carriage speeds and the vacuum fan frequencies yields a variety of wavelengths (λ) from which the controller 404 may select to apply during a printing pass. Thus, it may be unnecessary to vary either the carriage speed or the vacuum fan frequencies to a relatively large extent for the principles of the present invention to be implemented.

Referring back to FIG. 5, a printing pass may be made over the medium by the carriage supporting the printhead 414 at step 516. According to a preferred embodiment of the present invention, the selected degree of voltage variance and/or the carriage speed variance may be applied prior to making the printing pass. However, the selected degree of voltage variance and/or the carriage speed variance may also be selected during a printing pass without deviating from the scope or spirit of the present invention. Thus, for example, the voltage variance and/or the carriage speed variance may be selected and applied during the printing pass itself.

At step 522, it is determined whether any additional printing passes are required. If more printing passes are not required, then the program goes into an idle mode at step 524, i.e., shuts down, idles, etc. If additional printing passes are required, then the process is repeated starting with step 508. The above-described process continues until additional printing passes are not required, typically resulting in a printed image.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method for reducing vertical banding in a printing device, said printing device having a printhead and at least one of a fan device and a vacuum device, said method comprising the steps of:

supplying a first voltage to said at least one of a fan device and a vacuum device, wherein said first voltage is operable to cause said at least one of a fan device and a vacuum device to vibrate at a first frequency;

performing a first printing pass over a medium;

varying said first voltage to a second voltage;

supplying said second voltage to said at least one of a fan device and a vacuum device, wherein said second voltage is operable to cause said at least one of a fan device and a vacuum device to vibrate at a second frequency that differs from said first frequency; and performing a subsequent printing pass over said medium.

2. The method according to claim 1, wherein said step of varying said supplied voltage comprises the step of varying said first voltage a maximum of about plus or minus 10%.

3. The method according to claim 1, wherein said step of varying said first voltage comprises the further step of selecting a degree of variance during said step of performing a subsequent printing pass.

4. The method according to claim 3, wherein said step of supplying said second voltage comprises the further step of supplying said second voltage during said step of performing a subsequent printing pass.

5. The method according to claim 1, wherein said step of performing a first printing pass over said medium comprises the further step of maneuvering said printhead over said medium at a first speed.

6. The method according to claim 5, further comprising the step of varying said first speed to a second speed prior to said step of performing a subsequent printing pass.

7. The method according to claim 6, wherein said step of varying said first speed to said second speed further comprises the step of selecting said second speed from about a maximum of the sum of the first speed plus or minus approximately 8% of the first speed.

8. The method according to claim 6, wherein said step of performing a subsequent printing pass comprises the further step of maneuvering said printhead over said medium at said second speed.

9. The method according to claim 6, wherein said step of varying said first speed comprises the further step of selecting a degree of first speed variance during said step of the performing a subsequent printing pass.

10. The method according to claim 9, wherein said step of performing a subsequent printing pass comprises the further step of maneuvering said printhead over said medium at said second speed.

11. The method according to claim 1, wherein said at least one of a fan device and a vacuum device comprises a vacuum holder.

12. A method for reducing vertical banding in a printing device, said printing device having a printhead and a vacuum fan, said method comprising the steps of:

supplying a first voltage to said vacuum fan, wherein said first voltage is operable to cause said vacuum fan to vibrate at a first frequency;

performing a first printing pass over a medium;

varying said first voltage to a second voltage;

supplying said second voltage to said vacuum fan, wherein said second voltage is operable to cause said vacuum fan to vibrate at a second frequency that differs from said first frequency; and performing a subsequent printing pass over said medium.

13. A method for reducing vertical banding in a printing device, said printing device having a printhead and at least one of a fan device and a vacuum device, said method comprising the steps of:

supplying a first voltage to said at least one of a fan device and a vacuum device, wherein said first voltage is operable to cause said at least one of a fan device and a vacuum device to vibrate at a first frequency;

performing a first printing pass over a medium at a first speed;

varying said first voltage to a second voltage, wherein said first voltage differs from said second voltage;

supplying said second voltage to said at least one of a fan device and a vacuum device, wherein said second voltage is operable to cause said at least one of a fan device and a vacuum device to vibrate at a second frequency;

varying said first speed to a second speed, said second speed not being equal to said first speed; and performing a subsequent printing pass over said medium at said second speed.

14. The method according to claim 13, wherein said step of varying said first speed to said second speed further comprises the step of selecting said second speed from about a maximum of the sum of the first speed plus or minus approximately 8% of the first speed.

15. The method according to claim 13, wherein said step of varying said first speed comprises the further step of selecting a degree of first speed variance during said step of performing a subsequent printing pass.

16. The method according to claim 13, wherein said step of performing a subsequent printing pass comprises the further step of maneuvering said printhead over said medium at said second speed.

17. The method according to claim 13, wherein said step of varying said first voltage comprises the step of varying said first voltage a maximum of about plus or minus 10%.

18. The method according to claim 13, wherein said step of varying said first voltage comprises the further step of selecting a degree of voltage variance during said step of performing another printing pass.

19. The method according to claim 13, wherein said step of supplying said second voltage comprises the further step of supplying said second voltage during said step of performing a subsequent printing pass.

20. The method according to claim 13, wherein said at least one of a fan device and a vacuum device comprises a vacuum fan.

21. A computer readable storage medium on which is embedded one or more computer programs, said one or more computer programs implementing a method for reducing vertical banding during a printing operation of a printer, said one or more computer programs comprising a set of instructions for:

supplying a first voltage to at least one of a fan device and a vacuum device, wherein said first voltage is operable to cause said at least one of a fan device and a vacuum device to vibrate at a first frequency;

performing a first printing pass over a medium;

varying said first voltage to a second voltage;

supplying said second voltage to said at least one of a fan device and a vacuum device, wherein said second voltage is operable to cause said at least one of a fan device and a vacuum device to vibrate at a second frequency that differs from said first frequency; and performing a subsequent printing pass over said medium.

22. The computer readable storage medium according to claim 21, said one or more computer programs further comprising a set of instructions for:

performing said first printing pass over said medium at a first speed;

varying said first speed to a second speed prior to performing said subsequent printing pass.

23. An apparatus for reducing vertical banding in a printing device, said printing device having a printhead, said apparatus comprising:

at least one of a fan device and a vacuum device operable to vibrate at a frequency of rotation corresponding to a voltage supplied to said at least one of a fan device and a vacuum device; and a controller configured to control a supply of voltage to said at least one of a fan device and a vacuum device and signal said printhead to perform printing passes over a medium;

wherein said controller is operable to modify said supply of voltage to said at least one of a fan device and a vacuum device for said printing passes to thereby vary the frequency of vibration of said at least one of a fan device and a vacuum device during said printing passes.

24. The apparatus according to claim 23, wherein said controller is operable to signal said printhead to perform said initial and subsequent passes at differing speeds.

25. The apparatus according to claim 23, wherein said at least one of a fan device and a vacuum device comprises a vacuum fan.

26. An apparatus for reducing vertical banding in a printing device, said printing device having a printhead, said apparatus comprising:

a vacuum fan operable to vibrate at a frequency of rotation corresponding to a voltage supplied to said vacuum fan; and a controller configured to control a supply of voltage to said vacuum fan and signal said printhead to perform printing passes over a medium;

wherein said controller is operable to modify said supply of voltage to said vacuum fan for said printing passes to thereby vary the frequency of vibration of said vacuum fan during said printing passes.

27. A method for reducing vertical banding in a printing device, said printing device having a printhead and a vacuum fan, wherein an operation of said vacuum fan may cause a voltage receiving component to vibrate at a frequency of rotation that is configured to vary according to a degree of voltage supplied to said vacuum fan, said method comprising the steps of:

supplying a first voltage to said vacuum fan;

performing a first printing pass over a medium;

varying said first voltage to a second voltage to thereby vary said frequency of rotation of said vacuum fan;

supplying said second voltage to said vacuum fan; and performing a subsequent printing pass over said medium.

28. The method according to claim 27, further comprising:

performing said first printing pass over said medium at a first speed;

varying said first speed to a second speed prior to performing said subsequent printing pass.

29. The method according to claim 27, wherein said voltage receiving component comprises a component of the printing device.

* * * * *